US006080518A

United States Patent [19]

Levin et al.

[11] Patent Number: 6,080,518

[45] **Date of Patent: *Jun. 27, 2000**

[54] ELECTROPHOTOGRAPHIC PHOTOCONDUCTOR CONTAINING SIMPLE QUINONES TO IMPROVE ELECTRICAL PROPERTIES

[75] Inventors: Ronald Harold Levin; Scott Thomas Mosier, both of Boulder, Colo.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 09/327,933

[22] Filed: Jun. 8, 1999

[51] Int. Cl.[7] ..... G03G 5/047

[52] U.S. Cl. ..... 430/58.4; 430/58.75; 430/58.8; 430/59.4; 430/59.5; 430/83

[58] Field of Search ..... 430/58.35, 58.45, 430/58.65, 58.75, 58.8, 59.4, 59.5, 83

[56] References Cited

U.S. PATENT DOCUMENTS

| | | | |
|---|---|---|---|
| 3,877,935 | 4/1975 | Regensburger et al. | 430/58.25 |
| 5,075,189 | 12/1991 | Ichino et al. | 430/58.4 |
| 5,134,050 | 7/1992 | Eto et al. | 430/70 |
| 5,190,839 | 3/1993 | Fujimaki et al. | 430/78 |
| 5,213,923 | 5/1993 | Yokoyama et al. | 430/58.25 |
| 5,213,928 | 5/1993 | Yu | 430/66 |
| 5,328,789 | 7/1994 | Nakamori et al. | 430/58.25 |
| 5,424,158 | 6/1995 | Murakami et al. | 430/83 |
| 5,449,580 | 9/1995 | Nakamori et al. | 430/83 |
| 5,677,097 | 10/1997 | Nukada et al. | 430/60 |
| 5,705,694 | 1/1998 | Kawaguchi et al. | 430/58.35 |
| 5,707,766 | 1/1998 | Nogami et al. | 430/58.35 |
| 5,718,997 | 2/1998 | Hayata et al. | 430/58.35 |

FOREIGN PATENT DOCUMENTS

| | | |
|---|---|---|
| 426445A2 | 5/1991 | European Pat. Off. . |
| 506387A2 | 9/1992 | European Pat. Off. . |
| 699962A1 | 3/1996 | European Pat. Off. . |

OTHER PUBLICATIONS

Y. Yamaguchi et al. Chem. Mater 3:709–714 (1991).

*Primary Examiner*—Roland Martin
*Attorney, Agent, or Firm*—John A. Brady

[57] ABSTRACT

A photoconductor for use in electrophotographic reproduction devices is disclosed. The photoconductor provides simultaneous improvement in both photoreceptor sensitivity and fatigue, while also providing higher charge voltage, lower residual voltage and lower dark decay. The photoconductor of the present invention includes simple quinone additives in either the charge generation layer, the charge transport layer, or both layers. Quinone additives are preferably selected from o-quinone, duroquinone, diphenoquinone, naphthaquinone, and mixtures of those materials, with duroquinone and the mixture E+Z 3, 3'-di-t-butyl-5, 5'-dimethyl diphenoquinones being preferred.

11 Claims, No Drawings

ELECTROPHOTOGRAPHIC PHOTOCONDUCTOR CONTAINING SIMPLE QUINONES TO IMPROVE ELECTRICAL PROPERTIES

TECHNICAL FIELD

The present invention relates to a photoconductor, used in electrophotographic reproduction devices, which exhibits improved photoreceptor sensitivity without negatively impacting on its cycling fatigue properties.

BACKGROUND OF THE INVENTION

The present invention is a layered electrophotographic photoconductor, i.e., a photoconductor having a metal ground plane member on which a charge generation layer and a charge transport layer are coated, generally in that order. Although these layers are generally separate from each other, they may be combined into a single layer which provides both charge generation and charge transport functions. Such a photoconductor may optionally include a barrier layer located between the metal ground plane member and the charge generation layer, an adhesion-promoting layer located between the barrier (or ground plane member) and the charge generation layer, and/or an overcoat layer on the top surface of the charge transport layer.

In electrophotography, a latent image is created on the surface of an insulating, photoconducting material by selectively exposing an area of this surface to light. A difference in electrostatic charge density is created between the areas on the surface exposed and unexposed to the light. The latent electrostatic image is developed into a visible image by electrostatic toners containing pigment components and thermoplastic components. The toners, which may be liquids or powders, are selectively attracted to the photoconductor surface, either exposed or unexposed to light, depending upon the relative electrostatic charge on the photoconductor surface and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor surface, pulling the toner from that surface onto the paper or the transfer medium still in the pattern of the image developed from the photoconductor surface. A set of fuser rolls melts and fixes the toner on the paper, subsequent to direct transfer or indirect transfer when an intermediate transfer medium is used, producing the printed image.

The electrostatic printing process, therefore, comprises an on-going series of steps in which the photoconductor surface is charged and discharged as the printing takes place. It is important to keep the charge voltage on the surface of the photoconductor relatively constant as different pages are printed to make sure that the quality of the images produced is uniform (cycling stability). If the charge/discharge voltage is changed significantly each time the drum is cycled, i.e., if there is fatigue or other significant change in the photoconductor surface, the quality of the pages printed will not be uniform and, as a result, will not be satisfactory.

As electrophotography matures, increasingly demanding applications are envisioned for it. For example, printers that produce an increased number of prints per minute are always being developed. In order to produce more prints per minute, such printers operate at higher process speeds. If laser output power remains fixed, then the higher process speed means that less laser energy per square centimeter will be available to discharge the photoconductor, hence higher sensitivity is required of the photoconductor to get high quality prints. Similarly, color printers that use a number of photoreceptors in a serial arrangement typically have low output speeds because the electrophotographic process must be repeated on each drum. In order to provide color output at acceptable speeds, process speeds must be increased and, again, the same increased photosensitivity is required. Further, color devices that use a number of photoreceptors in a serial arrangement must ensure that photoreceptor fatigue is minimal. Drums, representing the different colors to be printed, are electrically "written" or cycled to different degrees, depending upon the demand for each specific color in the final print. For example, the drum used for printing black would most likely be electronically cycled much more frequently than the drum used for printing magenta. In order to ensure faithful color reproduction over the useful life of the photoconductor, the drums cannot fatigue at different rates. This is best achieved by minimizing photoconductor fatigue.

It is relatively easy to improve either sensitivity or fatigue, but such beneficial modification of one parameter usually results in a worsening of the other property. For example, increased sensitivity can be obtained by simply adding more charge generating material to the photoreceptor. Unfortunately, this approach also leads to an increase in photoconductor fatigue and dark decay. Because it is relatively difficult to simultaneously improve both sensitivity and fatigue, ways to achieve such simultaneous improvement of photoreceptors are of value and are constantly being sought.

The present invention is based on the unexpected finding that the incorporation of simple quinones into either the charge generation layer comprising a phthalocyanine charge generation molecule, or the charge transport layer comprising an amine charge transport molecule, provides simultaneous improvement in both sensitivity and fatigue of a photoconductor. In addition, the photoconductor exhibits higher charge voltage, lower residual voltage and lower dark decay when compared with similar photoconductors which do not include the quinone component.

The use of quinones as a class of materials in laminated photoreceptors is not new. Large, polycyclic quinones, long recognized as dyes or pigments, have been used in the colorant industry for centuries. Hence, their use as light-absorbing charge generating molecules has been widely explored and documented. See, for example, U.S. Pat. No. 5,677,097, Nukada, et al., issued Oct. 14, 1997; U.S. Pat. No. 5,190,839, Fujimaki, et al., issued Mar. 2, 1993; U.S. Pat. No. 5,075,189, Ichino, et al., issued Dec. 24, 1991; and U.S. Pat. No. 3,877,935, Regensburger, et al., issued Apr. 15, 1975. When used as a charge-generating molecule, the quinone actually absorbs actinic radiation and begins the charge separation which is central to the electrophotographic process. In contrast to this, the present invention uses simple quinones, rather than large polycyclic quinone dyes or pigments, and the molecules do not absorb the actinic radiation or initiate the charge generation process.

Quinones have also been used in the charge transport layer of laminated photoreceptors as charge transport molecules in systems involving electron transport via radical anions through the charge transport layer. See, for example, Yamaguchi, Y. et al., Chem. Mater. 3: 709–714 (1991); European Published Patent Application 426 445 A2, Yokoyarna, et al., published May 8, 1991; European Published Patent Application 699 962 A1, Nogami, S., et al., filed Mar. 6, 1996; and European Published Patent Application 506 387 A2, Tanaka, et al., filed Sep. 30, 1992. In the present invention, the quinones are not used at levels where they can transport charge through the charge transport layer.

U.S. Pat. No. 5,707,766, Nogami, et al, issued Jan. 13, 1998, describes an electrophotographic member which exhibits stable electrical characteristics during repeated use. The electrophotographic member incorporates mixtures of hydrobenzoic acid compounds and quinone compounds in the charge transport layer. This patent exemplifies only DEH as the charge transport agent, a material which is not operable in the present invention.

U.S. Pat. No. 5,134,050, Eto, et al., issued Jul. 28, 1992, describes a photoreceptor having a light sensitive layer which includes a specific polycyclic quinone compound (containing at least six rings), a specific bisazo pigment, and a specific stilbene as a charge transport material. These photoreceptors are taught to be highly sensitive and capable of accurately reproducing red images. The quinones utilized in this invention are complex and are not the simple quinones used in the present invention.

U.S. Pat. No. 5,449,580, Nakamori, et al., issued Sep. 12, 1995, describes a photosensitive material used for electrophotography which contains a specific diphenoquinone as an electron-transporting agent. The diphenoquinone component must have at least one aryl substituent. The material is utilized as the electron transport material and, therefore, is utilized at a relatively high level.

Yamaguchi, et al., Chem. Mater. 3: 709–714 (1991), describes unsymmetrically substituted diphenoquinones at high loading as effective electron transport compounds for use in photoconductors. 3,5-dimethyl-3', 5'-di-t-butyl-4, 4' diphenoquinone is specifically disclosed.

EPO Published Patent Application 426 445, Yokoyama, et al., published May 8, 1991, describes a photosensitive material for use in electrophotography which comprises an organic polysilane as the charge transport substance and a number of other materials, one of which is a diphenoquinone derivative. The material is said to maintain charging stability on repeated uses and is also said to control fatigue. The disclosed electrophotographic members do not utilize the amine charge transport materials required in the present invention, but instead require the use of a polysilane charge transport material.

SUMMARY OF THE INVENTION

The present invention relates to an electrophotographic imaging member comprising a charge generation layer comprised of a phthalocyanine charge generation molecule, a polymeric binder, and from about 1% to about 12% (based on the weight of said layer) of an additive selected from the group consisting of unsubstituted and $C_1$–$C_4$ alkyl substituted mono-quinones, di-quinones, tri-quinones, and mixtures thereof. Higher oxidizing quinones, such as duroquinone and diphenoquinone are preferred. A particularly preferred material is the isomeric mixture E+Z 3,3'-di-t-butyl-5, 5'-dimethyl diphenoquinone.

The present invention also relates to an electrophotographic member comprising a charge transport layer comprised of an amine charge transport molecule, a polymeric binder, and from about 1% to about 12% (based on the weight of said layer) of an additive selected from the group consisting of unsubstituted and $C_1$–$C_4$ substituted mono-quinones, di-quinones, tri-quinones and mixtures thereof. Preferred quinones include the higher oxidizing quinones, such as duroquinone and diphenoquinone, particularly the isomeric mixture E+Z 3,3'-di-t-butyl-5,5'-dimethyl diphenoquinone.

More specifically, the present invention relates to an electrophotographic imaging member comprising:

(a) a ground plane member;

(b) a charge generating layer carried by said ground plane member comprising an effective amount of a phthalocyanine charge generation molecule dispersed in a polymeric binder; and (c) a charge transport layer carried by such charge generating layer comprising an effective amount of an amine charge transport molecule dispersed in a polymeric binder;

wherein said charge generating layer, said charge transport layer or both of said layers includes from about 1% to about 12% (based on the weight of said layers) of an additive selected from the group consisting of unsubstituted and $C_1$–$C_4$ alkyl substituted mono-quinones, di-quinones, tri-quinones, and mixtures thereof. Preferred quinones are as defined above.

As used herein, all percentages, ratios and parts are "by weight", unless otherwise specified.

DETAILED DESCRIPTION OF THE INVENTION

Photoconductors of the present invention find utility in electrophotographic reproduction devices, such as copiers and printers, and may be generally characterized as layered photoconductors wherein one layer (the charge generating layer) absorbs light and, as a result, generates an electrical charge carrier, while a second layer (the charge transport layer) transports the charged carriers to the exposed surface of the photoconductor.

While these devices frequently have separate charge generation and charge transport layers with the charge transport layer being overlayed on the charge generating layer (or vice versa), it is also possible to combine the charge generator and charge transport functions into a single layer in the photoconductor.

In the photoconductor structure, a substrate, which may be flexible (such as a flexible web or a belt) or inflexible (such as a drum), includes a thin layer of metallic aluminum. The aluminum layer functions as an electrical ground plane. In a preferred embodiment, the aluminum is anodized which turns the aluminum surface into a thicker aluminum oxide surface (adding a thickness of about 2 to about 12$\mu$, preferably from about 4 to about 7$\mu$). The ground plane member may be a metallic plate (made, for example, from aluminum or nickel), a metallic drum or a foil, a plastic film on which, for example, aluminum, tin oxide or indium oxide has been vacuum evaporated, or a conductive substance-coated paper, plastic film or a drum.

The aluminum layer is then generally coated with a thin, uniform thickness charge-generating layer comprising a photosensitive dye material dispersed in a binder. Finally, the uniform thickness charge transport layer is coated onto the charge generating layer. The order of these layers may be reversed. The quinone component of the present invention may be included in either the charge generating layer, the charge transport layer, or both layers. When the quinone is included in the charge generating layer, that layer comprises a phthalocyanine charge generating molecule, a binder resin, and the quinone material. When the quinone material is included in the charge transport layer, that layer comprises an amine charge transport molecule, a polymeric binder, and the quinone material.

In the case of a single layer structure, the photosensitive layer comprises a phthalocyanine charge generating material, an amine charge transport material, a binder resin, and the quinone additive.

The thickness of the various layers in the structure is important and is well known to those skilled in the art. In an exemplary conductor, the ground plane layer has a thickness of from about 0.01 to about 0.07$\mu$; the charge generating layer has a thickness of from about 0.5 to about 5.0$\mu$, preferably from about 0.1 to about 2.0$\mu$, most preferably from about 0.1 to about 0.5$\mu$, and the charge transport layer has a thickness of from about 10 to about 25$\mu$, preferably from about 20 to about 25$\mu$. If a barrier layer is used between the ground plane and the charge generating layer, typically it has a thickness of from about 0.5 to about 2.0$\mu$. Where a single charge generating/charge transport layer is used, that layer generally has a thickness of from about 10 to about 25$\mu$.

In forming the charge generating layer utilized in the present invention, a fine dispersion of a small particle photosensitive phthalocyanine dye material is formed in the binder material, and this dispersion is coated onto the ground plane member. This is generally done by preparing the dispersion containing the photosensitive dye and the binder and a solvent, coating the dispersion onto the ground plane member, and drying the coating.

The photosensitive dyes used in the present invention are phthalocyanine dyes, which are well known to those skilled in the art. Examples of such materials are taught in U.S. Pat. No. 3,816,118, Byrne, issued Jun. 11, 1974, incorporated herein by reference. Any suitable phthalocyanine may be used to prepare the charge generating layer portion of the present invention. The phthalocyanine used may be in any suitable crystalline form. It may be unsubstituted either (or both) in the six-membered aromatic rings and at the nitrogens of the five-membered rings. Useful materials are described, and their syntheses given, in Moser & Thomas, *Phthalocyanine Compounds*, Reinhold Publishing Company, 1963, incorporated herein by reference. Particularly preferred phthalocyanine materials are those in which the metal central to the structure is titanium (i.e., titanyl phthalocyanines). Metal-free phthalocyanines are also particularly preferred, especially the X-crystalline form, metal-free phthalocyanines. Such materials are disclosed in U.S. Pat. No. 3,357,989, Byrne, et al., issued Dec. 12, 1967; U.S. Pat. No. 3,816,118, Byrne, issued Jun. 11, 1974; and U.S. Pat. No. 5,204,200, Kobata, et al., issued Apr. 20, 1993, all of which are incorporated herein by reference. The X-type non-metal phthalocyanine is represented by the formula:

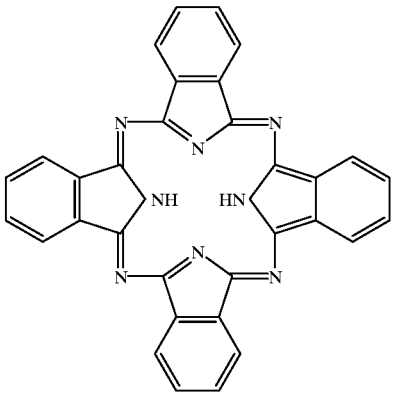

Such materials are commercially available in an electrophotographic grade of very high purity, for example, under the trade name Progen-XPC from Zeneca Colours Company, or under the name type IV oxo-titanyl phthalocyanine from Syntec.

As the binder, a high molecular weight polymer having hydrophobic properties and good film-forming properties for an electrically insulating film is preferably used. These high molecular weight film-forming polymers include, for example, the following materials, but are not limited thereto: polycarbonates, polyesters, methacrylic resins, acrylic resins, polyvinyl chlorides, polyvinylidene chlorides, polystyrenes, polyvinylbutyrals, ester-carbonate copolymers, polyvinyl acetates, styrene-butadiene copolymers, vinylidene chloride-acrylonitrile copolyers, vinyl chloride-vinyl acetate copolymers, vinyl chloride-vinyl acetate-maleic anhydride copolymers, silicone resins, silicone alkyd resins, phenyl-formaldehyde resins, styrene-alkyd resins, and poly-N-vinylcarbazoles. These binders can be used in the form of a single resin or in a mixture of two or more resins.

Specific examples of binder materials which may be used in the charge generating (and charge transport) layer include the bisphenol A and bisphenol A—bisphenol TMC copolymers described below, medium molecular weight polyvinyl chlorides, polyvinylbutyrals, ester-carbonate copolymers, and mixtures thereof The polyvinyl chloride compounds useful as binders have an average molecular weight (weight average) of from about 25,000 to about 300,000, preferably from about 50,000 to about 125,000, most preferably and 80,000. The PVC material may contain a variety of substituents including chlorine, oxirane, acrylonitrile or butyral, although the preferred material is unsubstituted. Polyvinyl chloride materials useful in the present invention are well-known to those skilled in the art. Examples of such materials are commercially available as GEON 110X426 from the GEON Company. Similar polyvinyl chlorides are also available from the Union Carbide Corporation.

Bisphenol A, having the formula given below, is a useful binder herein:

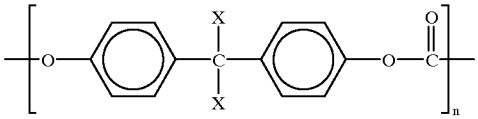

wherein each X is a $C_1$–$C_4$ akyl and n is from about 20 to about 200.

Another type of preferred bisphenol binder referred to above are copolymers of bisphenol A and bisphenol TMC. This copolymer has the following formula:

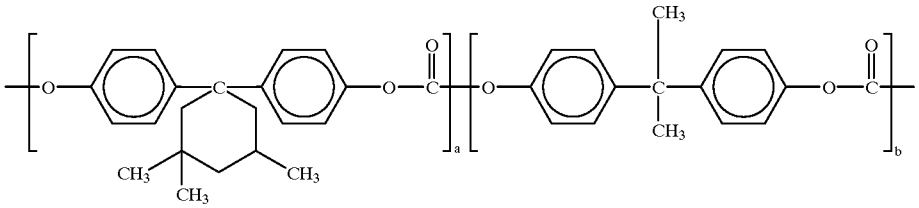

wherein a and b are selected such that the weight ratio of bisphenol A to bisphenol TMC is from about 30:70 to about 70:30, preferably from about 35:65 to about 65:35, most preferably from about 40:60 to about 60:40. The molecular weight (weight average) of the polymer is from about 10,000 to about 100,000, preferably from about 20,000 to about 50,000, most preferably from about 30,000 to about 40,000.

Polyvinylbutyrals are the preferred binders for use in the charge generating layer.

In forming the charge generating layer, a mixture of the photosensitive dye is formed in the binder material. The amount of photosensitive dye used is that amount that is effective to provide the charge generation function in the photoconductor. This mixture generally contains from about 10 parts to about 65 parts, preferably from about 20 parts to about 50 parts, most preferably about 45 parts of the photosensitive dye component, and from about 35 parts to about 90 parts, preferably from about 50 parts to about 80 parts, most preferably about 55 parts of the binder component.

The photosensitive dye-binder mixture is then mixed with a solvent or dispersing medium for further processing. The solvent selected should: (1) be a true solvent for high molecular weight polymers; (2) be non-reactive with all components; and (3) have low toxicity. Examples of dispersing media/solvents that may be utilized in the present invention, used either alone or in combination with preferred solvents, include hydrocarbons, such as hexane, benzene, toluene, and xylene; halogenated hydrocarbons, such as methylene chloride, methylene bromide, 1,2-dichloroethane, 1,1,2-trichloroethane, 1,1,1-trichloroethane, 1,2-dichloropropane, chloroform, bromoform, and chlorobenzene; ketones, such as acetone, methylethyl ketone and cyclohexanone; ethers, such as ethyl acetate and butyl acetate; alcohols, such as methanol, ethanol, propanol, butanol, cyclohexanol, heptanol, ethylene glycol, methylcellosolve, ethylcellosolve, and derivatives thereof; ethers and acetals, such as tetrahydrofuran, 1,4-dioxane, furan and furfural; amines, such as pyridine, butylamine, diethylamine, ethylene diamine, isopropanolamine; nitrogen compounds, including amides, such as N, N-dimethylformamide; fatty acids and phenols; and sulfur and phosphorous compounds, such as carbon disulfide and triethyl phosphate. The preferred solvents for use in the present invention are methyl ethyl ketone and cyclohexanone. The mixtures formed include from about 1% to about 50%, preferably from about 2% to about 10%, most preferably about 5% of the photosensitive dye/binder mixture, and from about 50% to about 99%, preferably from about 90% to about 98%, most preferably about 95%, of the solvent-dispersing medium. The entire mixture is then ground, using a conventional grinding mechanism, until the desired dye particle size is reached and the particles are dispersed in the mixture. The organic pigment may be pulverized into fine particles using, for example, a ball mill, homogenizer, paint shaker, sand mill, ultrasonic disperser, attritor or sand grinder. The preferred device is a sand mill grinder. The phthalocyanine photosensitive dye has a particle size (after grinding) ranging from sub-micron (e.g., about 0.01$\mu$) to about 5, with a particle size of from about 0.5$\mu$ to about 5$\mu$ being preferred. The mixture may then be "let down" or diluted with additional solvent from about 2% to about 5% solids, providing a viscosity appropriate for coating, for example, by dip-coating.

The charge generating layer is then coated on to the ground plane member. The dispersion from which the charge generating layer is formed is coated onto the ground plane member using methods well known in the art, including dip coating, spray coating, blade coating, or rollcoating, and is then dried. The preferred method for use in the present invention is dipcoating. The thickness of the charge generating layer formed should preferably be from about 0.1 to about 2.0$\mu$, preferably about 0.5$\mu$. The thickness on the layer will depend upon the percent solids of the dispersions into which the ground plane member is dipped, as well as the time and temperature of the process. Once the ground plane member has been coated with the charge generating layer, it is allowed to dry for a period from of about 5 to about 100 minutes, preferably from about 5 to about 30 minutes, at a temperature of from about 25° C. to about 160° C., preferably between about 25° C. and about 100° C.

The charge transport layer is then prepared and coated on the ground plane member so as to cover the charge generating layer. The charge transport layer is formed from a solution containing an amine charge transport molecule in a thermoplastic film-forming binder. The solution may also contain the quinone additive described in the present application. The solution is then coated onto the charge generating layer and the coating is dried.

The charge transport material used in the present invention is an amine material, preferably an aromatic amine compound, having the general formula:

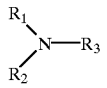

wherein $R_1$, $R_2$ and $R_3$ are aromatic groups independently selected from the group consisting of substituted or unsubstituted phenyl groups, naphthyl groups, and polyphenyl groups. $R_1$, $R_2$ and $R_3$ may represent the same or different substituents. The substituents should be free from electron withdrawing groups such as $NO_2$ groups, CN groups and the like.

Examples of charge transport aromatic amines represented by the structural formula above for use in charge transport layers capable of supporting the injection of photogenerated holes from a charge generating layer and transporting the holes through the charge transport layer include bis(4-diethylamine-2-methylphenyl) phenylmethane; 4', 4"-bis(diethylamino)-2', 2"-dimethyltriphenylmethane; N, N'-bis (alkylphenyl)-[1,1'-diphenyl]-4,4' diamine, wherein the alkyl is, for example, methyl, ethyl, propyl, n-butyl, etc.; N, N', diphenyl-N, N'-bis (chlorophenyl)-[1,1' diphenyl]-4, 4' diamine; N, N'-diphenyl-N, N'-bis (3'-methylphenyl)-(1, 1'-diphenyl) 4, 4'-diamine, and the like. A particularly preferred charge transport material for use in the present invention is N, N'-bis-(3-methylphenyl)-N, N'-bis-phenyl benzidene (TPD).

The binders used in the charge transport layer of the present invention are the binders described above which are used in the charge generating layer. The preferred binders for use in the charge transport layer are the polycarbonates, such as the bisphenol A and bisphenol A-bisphenol TMC copolymers, previously described.

The essence of the present invention is the incorporation of simple quinone materials into either the charge transport layer, the charge generation layer, or both the charge transport and the charge generation layers of the electrophotographic member of the present invention. The quinone materials are included in these layers at from about 1% to about 12%, preferably from about 3% to about 6% of the solid materials in those layers. The quinone materials utilized are simple quinones, such as mono-quinones, di-quinones, and tri-quinones. Higher oxidizing quinones are preferred. Examples of such quinone materials include o-quinone, duroquinone, diphenoquinone, naphthoquinone, and mixtures thereof. These materials may be unsubstituted or they made be substituted with $C_1$–$C_4$ alkyl groups. Preferred quinone additives include duroquinone and diphenoquinones, such as a mixture of E +Z 3, 3'-di-tert-butyl-5, 5' dimethyl diphenoquinones. Formulas for these materials are given below. The particularly preferred quinone material for use in the present invention is a mixture of E+Z 3, 3' di-tert-butyl-5, 5' dimethyl diphenoquinones.

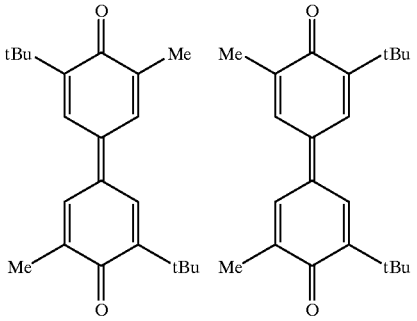

E + Z 3,3'-di-tert-butyl-5,5'dimethyldiphenoquinone

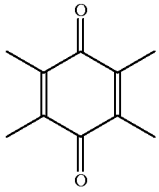

duroquinone

The mixture of charge transport molecule (as disclosed above), binder and quinone additive (when utilized in the charge transport layer) having a composition from about 25% to about 65%, preferably from about 30% to about 50%, most preferably from about 35% to about 45% of the amine charge transport molecule; from about 35% to about 65%, preferably from about 50% to about 65%, most preferably from about 55% to about 65% of the binder; and up to about 12%, preferably from about 1% to about 12%, most preferably from about 3% to about 6% of the quinone additive is then formulated. The amount of charge transport molecule utilized is that amount which is effective to perform the charge transport function in the photoconductor. The binders are used, both in the charge transport and charge generating layers in the amount effective to perform the binder function.

The mixture is added to a solvent, such as those discussed above for use in forming the charge generation layer. Preferred solvents are THF, cyclohexanone, and methylene chloride. It is preferred that the solution contain from about 10% to about 40%, preferably about 25% of the binder/transport molecule/quinone mixture, and from about 60% to about 90%, preferably about 75% of the solvent. The charge transport layer is then coated onto the charge generating layer and the ground plane member using any of the conventional coating techniques discussed above. Dip coating is preferred. The thickness of the charge transport layer is generally from about 10 to about 25$\mu$, preferably from about 20 to about 25$\mu$. The percentage of solids in the solution, viscosity, the temperature of the solution, and withdrawal speed control the thickness of the transport layer. The layer is usually heat dried for about 5 to about 100 minutes, preferably from about 5 to about 60 minutes, at a temperature from about 25° C. to about 160° C., preferably between about 25° C. and about 100° C. Once the transport layer is formed on the electrophotographic member, treatment of the layer by either using UV curing, or thermal annealing is preferred in that it further reduces the rate of transport molecule leaching, especially at higher transport molecule concentrations.

In addition to the layers discussed above, an undercoating layer may be placed between the ground plane member (substrate) and the charge generating layer. This is essentially a primer layer that covers over any imperfections in the substrate layer, and improves the uniformity of the thin charge generation layer formed. Materials that may used to form this undercoat include epoxy, polyamide, and polyurethane. It is also possible to place an overcoat layer (i.e., a surface protecting layer) on top of the transport layer. This protects the charge transport layer from wear and abrasion during the printing process. Materials which may be used to form this overcoat layer include polyurethane, phenolic, polyamide and epoxy resins. These structures are well known to those skilled in the art.

The following examples illustrate the photoconductors of the present invention. The examples are intended to be illustrative only and not limiting of the scope of the present invention.

EXAMPLES

Electrophotographic members of the present invention containing a quinone additive in the charge generation or charge transport layer, as well as controls which do not contain the quinone additive are formulated in the manner described below.

Charge generation layer (CGL) preparation: 2.0 g type IV titanyl phthalocyanine, 2.5 g polyvinyl butyral (PVB) (BX-55Z, Sekisui), 75 g cyclohexanone, and 60 ml of glass grinding beads are combined in a glass amber jar. The jar is shaken using a Red Devil paint shaker for 12 hours. 75 g methylethyl ketone (MEK) is added to the jar and the dispersion is shaken for an additional 1 hour. The dispersion produced is 2.9% solids and has a 45:55 pigment: binder ratio.

Charge transport layer (CTL) preparation: 13.9 g bisphenol A polycarbonate (Makrolon 5208) is dissolved in a mixture of 65 g tetrahydrofuran (THF) and 28 g 1,4-dioxane. To the dissolved polymer solution, 6.0 g N, N'-bis-3-methylphenyl-N, N'-bis-phenyl benzidine (TPD) and one drop of DC 200 silicone surfactant (Dow Corning) are added. The solution produced contains 17.6% solids and has a 30:70 charge transport molecule:binder ratio.

Coating: The CGL dispersion prepared above is coated on both an aluminized mylar substrate using a meniscus method and an anodized aluminum core using the standard dip-coating method. The coated CGL is cured in a forced air oven at 120° C. for 10 minutes to dry off the coating solvents. After cooling, the CTL solution is coated over the dry CGL. The resulting two-layer coated substrate, both mylar and drum, are cured for an additional 1 hour at 120° C. A dual layer photoconductor (control—i.e., without the quinone additive) is produced.

Example 1-Quinone Formulated in the CGL: A photoconductor is prepared as above, but with 0.18 g (4% of total solids) of 3, 3'-di-t-butyl-5, 5'-dimethyl diphenoquinone added in place of an equivalent amount of BX-55Z polyvinyl butyral in the CGL dispersion.

Example 2-Quinone Formulated in the CGL: A photoconductor is prepared as described above, but with 0.1 8 g (4% of total solids) of duroquinone added in place of an equivalent amount of BX-55Z polyvinyl butyral in the CGL dispersion.

Example 3-Quinone Formulated in the CTL: A photoconductor is prepared as described above, but with 0.2 g (1% of total solids) or 1 .0 g (5% of total solids) of 3, 3'-di-t-butyl-5, 5'-dimethyl diphenylquinone added in place of an equivalent amount of Makrolon 5208 bisphenol polycarbonate in the CTL solution.

Example 4-Quinone Formulated in the CTL: A photoconductor is prepared as described above, but with 0.22 g of DEH (1% of total solids) added to 12.5 g of the CTL solution prepared as in Example 1, above. The CTL is coated on an aluminized mylar web using a drawdown technique. A control photoconductor is made for comparative purposes containing 0.22 g of DEH added to 12.5 g of the CTL solution, but with no quinone added to it.

Testing Procedures: Electrical fatigue characteristics of the various photoconductors are evaluated by charging the photoconductor samples to −675V and then exposing them with an 819 nm laser at 0.54 uJ/cm$^2$ for 2.2K cycles. Three photoconductor samples coated on aluminized mylar are tested simultaneously. Charge (Vc), discharge (Vd), and dark decay voltages are recorded at 0, 1,000, and 2,200 cycles and plotted. Changes in Vc, Vd, and dark decay are compared. A separate instrument is used to generate voltage vs. energy curves on the same photoconductor samples coated on anodized aluminum cores. Samples are charged to −700V and are exposed with a 780 nm laser at energies from 0–1.76 u J/cm$^2$. The voltage is recorded across the range of exposure energies, plotted and evaluated. Dark decay is evaluated by charging the sample to −850V and recording the voltage drop after 1, 5 and 10 seconds.

Results: When the photoreceptor is coated on an aluminum mylar web and 4% of the CGL binder is replaced with a quinone, the initial charge levels are unaffected compared to an undoped standard. However, both of the quinone samples display a significantly reduced change in charge voltage upon cycling in comparison to the undoped standard. In other words, the charge voltage fatigue is reduced. Similarly, the change in discharge voltage upon cycling the quinone—doped samples is also much reduced in comparison to the undoped standard. This indicates that discharge voltage fatigue is also reduced. Furthermore, the discharge voltage starts off at a lower value in the quinone samples and it remains lower than the standard during cycling. This suggests that the sensitivity of the photoconductor has been increased. Finally, the dark decay rate is also reduced in the quinone-containing samples and its fatigue during cycling is also dramatically reduced in comparison to the standard. Similar results are obtained when the quinones are formulated into the CTL, as described above. Similar results are also obtained when the samples are coated on drums instead of webs.

When the quinones are used with a photoreceptor utilizing hydroxysquaraine in the charge generating layer as the charge generating molecule, and 40% DEH in the charge transport layer as the charge transport molecule, no improvement in electrical properties is seen.

In another set of experiments, the titanyl phthalocyanine CGL, described above, is overcoated with a 30% TPD-containing charge transport layer which is doped with 1% DEH (the N, N-diphenylhydrazone of 4-diethylaminobenzaldehyde). This latter hole transport material is known to act as a trap in the presence of TPD reducing the charge-discharge vector of electrophotographic member by as much as 150 volts, independent of cycle count. Such a photoreceptor would produce undesirable, washed-out prints. The incorporation of small amounts of quinone into the photoreceptor substantially alleviates this problem. When the quinone is present in the CTL, the vector is only reduced by 40–60 volts. Furthermore, since the dark decay is again reduced by nearly half, the effect of the 40–60 volt vector reduction is further minimized, making the photoreceptor containing the DEH and quinone usable. Traps are often added inadvertently to photoreceptors. Manufacturing line changeovers where the lines have not been adequately cleaned can often introduce molecules which act as traps. Traps also accompany the desired transport molecule as low yield synthetic by-products. These results show that addition of quinones to a photoreceptor has the added benefit of making the photoreceptor more robust and less sensitive to the presence of traps.

What is claimed is:

1. An electrophotographic imaging member comprising:

(a) a ground plane member;

(b) a charge generating layer carried by said ground plane member comprising an effective amount of a phthalocyanine charge generation molecule dispersed in a polymeric binder; and (c) a charge transport layer carried by said charge generating layer consisting essentially of an effective amount of a charge transport molecule having the formula:

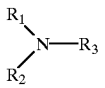

wherein $R_1$, $R_2$ and $R_3$ are aromatic groups selected from the group consisting of substituted and unsubstituted phenyl groups, naphthyl groups, and polyphenyl groups, dispersed in a polymeric binder; wherein said charge generating layer, said charge transport layer, or both of said layers includes from about 1% to about 6% of said layers of an additive consisting of a quinone selected from the group consisting of unsubstituted and $C_1$–$C_4$ alkyl substituted o-quinone duroquinone, diphenoguinone, naphthaquinone, and mixtures thereof.

2. The electrophotographic imaging member according to claim 1 wherein the additive is selected from the group consisting of duroquinone, diphenoquinone, and mixtures thereof.

3. The electrophotographic imaging member according to claim 2 wherein the charge generation layer comprises from about 3% to about 6% of the quinone additive.

4. The electrophotographic imaging member according to claim 2 wherein the additive is E+Z 3, 3'-di-t-butyl-5, 5'-dimethyl diphenoquinone.

5. The electrophotographic imaging member according to claim 2 wherein the charge generation molecule is a type IV titanyl phthalocyanine.

6. The electrophotographic imaging member according to claim 5 wherein the CGL polymeric binder is polyvinyl butyral.

7. The electrophotographic imaging member according to claim 1 which includes DEH in the charge transport layer.

8. The electrophotographic imaging member according to claim 1 wherein the CTL charge transport molecule is N, N'-bis-(3-methylphenyl)-N, N'-bis-phenyl benzidine (TPD).

9. The electrophotographic imaging member according to claim 8 wherein the polymeric binder is bisphenol A polycarbonate.

10. The electrophotographic imaging member according to claim 1 wherein the quinone additive is present in the charge generating layer.

11. The electrophotographic imaging member according to claim 1 wherein the quinone additive is present in the charge transport layer.

* * * * *

UNITED STATES PATENT AND TRADEMARK OFFICE

CERTIFICATE OF CORRECTION

PATENT NO: 6;080,518

DATED : June 27, 2000

INVENTOR(S) : Levin, Ronald H.; Mosier, Scott T.

It is certified that error appears in the above-identified patent and that said Letters Patent are hereby corrected as shown below:

Claim 1, column 12, line 65

After "o-quinone" insert -- , --.

Signed and Sealed this

Third Day of April, 2001

Nicholas P. Godici

*Attest:*

NICHOLAS P. GODICI

*Attesting Officer*

*Acting Director of the United States Patent and Trademark Office*